US005791023A

United States Patent [19]

Comerford

[11] Patent Number: 5,791,023

[45] Date of Patent: Aug. 11, 1998

[54] ZIP FASTENER

[75] Inventor: Brian Comerford, Cheshire, United Kingdom

[73] Assignee: YKK Corporation, Tokyo, Japan

[21] Appl. No.: 800,626

[22] Filed: Feb. 14, 1997

[30] Foreign Application Priority Data

Feb. 15, 1996 [GB] United Kingdom ..... 9603204

[51] Int. Cl.[6] ..... A44B 19/00

[52] U.S. Cl. ..... 24/386; 24/390; 24/434

[58] Field of Search ..... 24/386, 388, 390, 24/413, 434, 433; 70/68

[56] References Cited

U.S. PATENT DOCUMENTS

| | | | |
|---|---|---|---|
| 2,942,450 | 6/1960 | Krug | 70/68 |
| 3,775,812 | 12/1973 | Carver, Jr. | 24/390 |
| 3,900,926 | 8/1975 | Takahashi et al. | 24/386 |
| 3,973,419 | 8/1976 | Atkinson | 70/68 |
| 4,742,603 | 5/1988 | Kasai | 24/434 |
| 5,333,362 | 8/1994 | Gillioz | 24/434 |

*Primary Examiner*—Victor N. Sakran

*Attorney, Agent, or Firm*—Hill & Simpson

[57] ABSTRACT

A zip fastener has mouldings on the opposite tapes which hinder the movement of the sliders relative to the tapes. The movement of the sliders past the mouldings can be felt by the user and so helps indicate when the sliders, are in position at the bottom of one tape, ready to receive the male movable open parts pin. The moulding rides past a shoulder on the slider as the pin is pushed into position. The invention is also useful with fasteners having a single slider.

13 Claims, 6 Drawing Sheets

ZIP FASTENER

BACKGROUND OF THE INVENTION

1. Field of the Invention

The present invention relates to a zip fastener, and more particularly to a separable zip fastener in which positioning of a slider can be confirmed by fingers.

2. Description of the Prior Art

Zip fasteners on heavy duty outer garments are often handled using gloves, or are difficult to see. When coupling the two stringers of the fastener together, by inserting the male movable open parts pin into the female slider, the user can have difficulty determining that the slider is correctly positioned to receive the pin, or that the pin is slid fully home to allow the slider to be pulled along the stringers to close the zip.

SUMMARY OF THE INVENTION

The present invention provides a separable zip fastener having a slider and a pair of stringers, each stringer comprising coupling elements on a tape, wherein interference means is provided on at least one of the tapes to hinder the movement of the slider along the tape so that, when the slider is slid, a position of the slider along the tape is indicated by feel to a user.

The foregoing object is accomplished by the present invention which provides a zip fastener comprising a slider and a couple of opposed fastener stringers having engaging elements attached onto respective tapes, wherein interference means is provided on at least one of the tapes to hinder the movement of the slider and so indicate by feel to a user a position of the slider along the tape.

The interference means comprises a first and a second interference means. Preferably, the first interference means is provided at the end of the tape on which the slider is permanently mounted to indicate when the upper slider is positioned for receiving the male movable open parts pin. Also preferably, the second interference means is provided on the tape carrying the male movable open parts pin, to indicate when the male movable open parts pin has been inserted fully into the slider. And it is preferable that it is indicated when the male movable open parts pin has been moved inside the slider adequately so that the slider can move along the tape to close the zip fastener.

In a particularly preferred form, the interference means is provided on both stringer tapes, adjacent one end thereof. The first interference means on the tape carrying the slider bears on each of the upper and lower slider as it is slid to the end of the tape, and the second interference means on the other tape bears on and then rides past the slider as the male movable parts pin is inserted into the slider.

Further, the zip fastener may have a pair of upper and lower sliders. It is preferable that the first interference means is positioned so that it bears on each of the upper and lower sliders as each of the upper and lower sliders is slid to the end of the stringer. Also, the first interference means comprises on its tape edge side upper and lower sloping surfaces, sloping of the lower sloping surface being gentler than that of the upper sloping surface.

When the zip fastener has the double slider, a third interference means may be provided adjacent one end of the tape to indicate when the lower slider is positioned at the end of the stringer and to hinder the movement of the lower slider, as the other slider is pulled to close the fastener.

Further preferably, a third interference means is provided to indicate when the lower slider is positioned at the end of the stringer. And the first interference means indicates when the upper slider is positioned for receiving the male movable open parts pin.

Preferably, each of the interference means is formed by a plastics moulding provided on the respective stringer tape. The moulding may carry a logo.

DETAILED DESCRIPTION

The invention will be further described by way of example with reference to the accompanying drawings.

Figure 1:
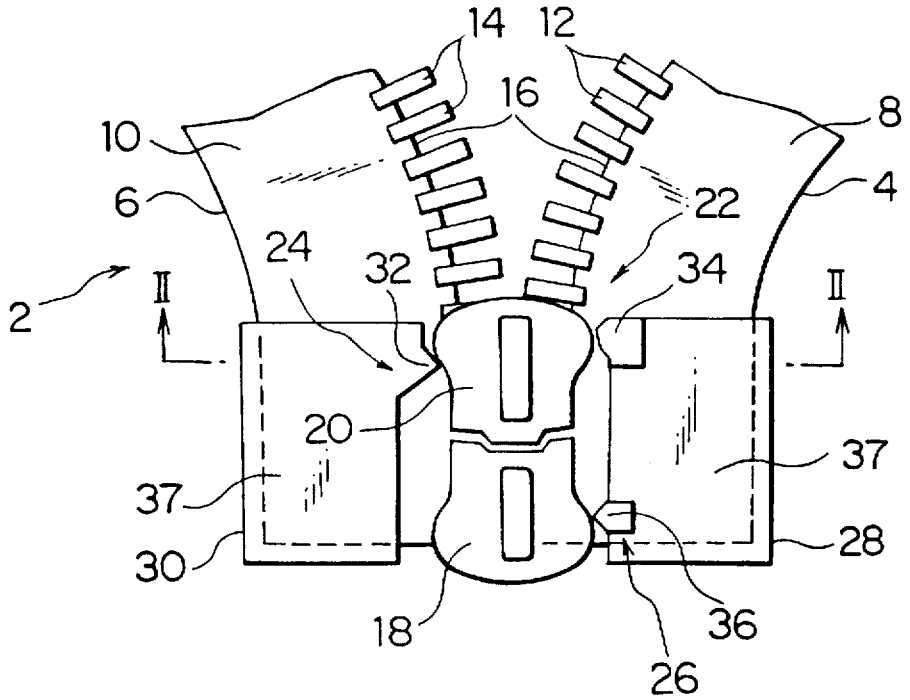
FIG. 1 is a fragmentary plan view of an end of a zip fastener forming a first embodiment of the invention.

Referring to FIG. 1, a zip fastener 2 comprises two stringers 4, 6 which each comprises a tape 8, 10 and respective coupling elements 12, 14. The coupling elements 12, 14 shown are discrete metal elements which grip the confronting edge 16 of the respective tape. Other arrangements may also be used, such as a continuous, coiled plastics coupling element which is woven into the tape at its edge 16 as is well known in the art.

Figure 3A:
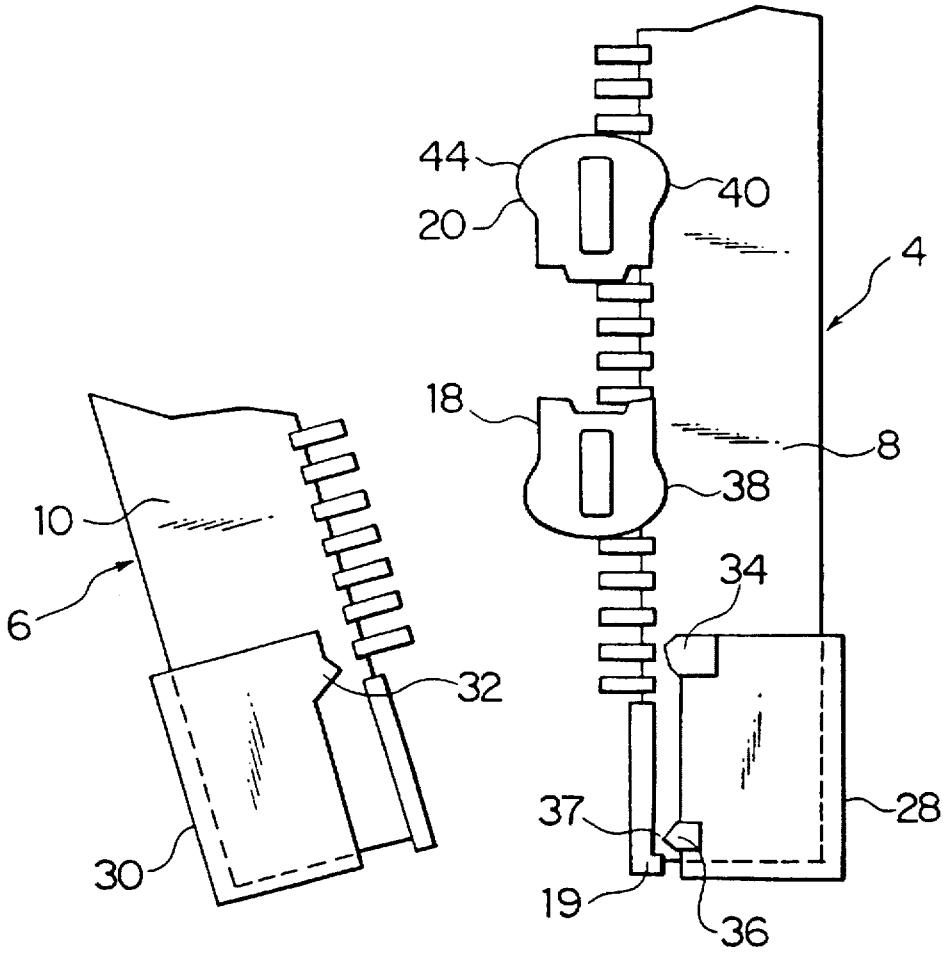
FIG. 3(A) to 3(D) show the operation of the zip fastener of FIG. 1.

The zip fastener 2 shown has a double slider arrangement comprising upper and lower sliders, 20, 18. The lower slider 18, as seen in the drawing, bears on a stop 19 (seen FIG. 3(A)), at the end of the right-hand, or female side, tape 8 to prevent it sliding off the end of the stringer 4.

For clarity, pullers which are used for pulling the sliders are not shown in the drawings.

Shown in FIG. 1 are first, second and third interference means 22, 24, 26. These project proud of the respective tape 8, 10 and overlap the line of travel of the outer edge or shoulders of the upper and lower sliders 20, 18. Thus, the movement of the upper and lower sliders 20, 18 is hindered as they ride past the respective interference means 22, 24, 26. These interference means 22, 24, 26 are formed by insert moulding polyester elastomer fittings 28, 30 onto the ends of the tapes 8, 10. The fittings 28, 30 may take various shapes.

The moulding 30 on the left-hand tape 10 is of uniform cross-section with a lateral protrusion 32 defining the interference means 24 while the moulding 28 on the right-hand tape 8 has laterally protruding and upstanding pillars 34, 36 which form the interference means 22, 26.

Figure 2:
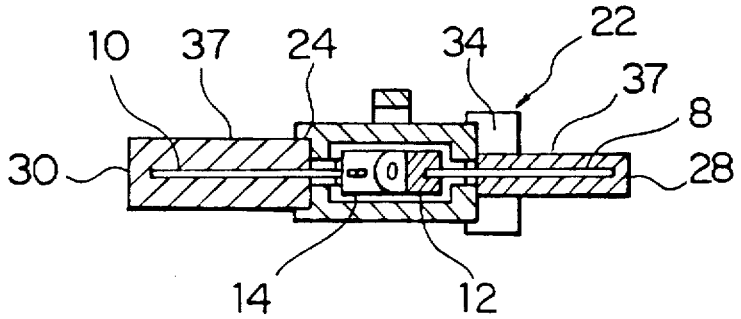
FIG. 2 is a cross-section along line II—II of FIG. 1.

As seen in FIG. 2, the respective mouldings 28, 30 are symmetrical about the plane of the respective tape 8, 10.

A substantially flat area 37 is provided on each moulding 28, 30 to carry a logo which may be moulded into the surface.

Preferably the mouldings 28, 30 are constructed in similar fashion and substantially symmetrical about the centre line of the closed fastener, for enhanced appearance. Thus, instead of the mouldings 28, 30 having shapes different from each other, either two, thicker type mouldings 30 or two thinner mouldings 28 with upstanding pillars are used.

Figure 3B:
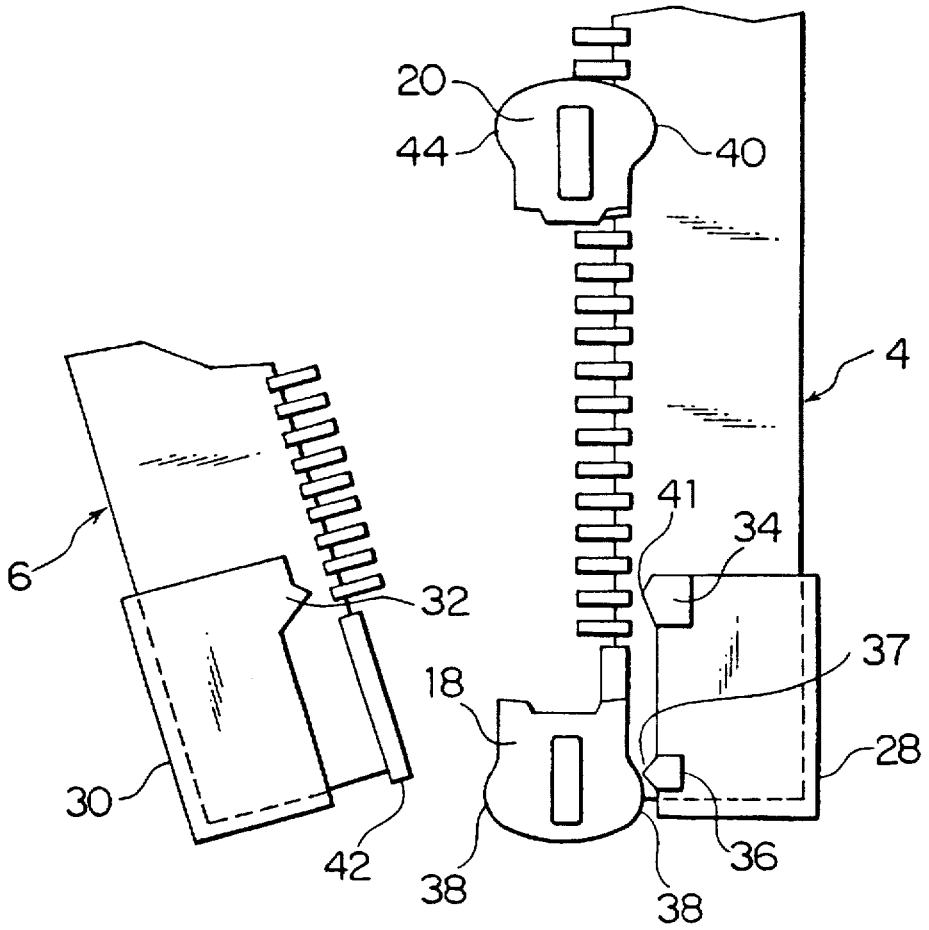

Referring to FIGS. 3(A) to 3(D), FIG. 3(A) shows the two sliders 18, 20 partway along the coupling elements on the right-hand stringer 4. In FIG. 3B, the lower slider 18 has been slid down to the end of the stringer 4, where the shoulder 38 on the slider is pushed past the pillars 34, 36. The user will "feel" the movement of the slider past the pillars 34, 36 and hence know that the slider 18 is in position at the bottom of the stringer. The pillar 36 has a projecting edge 37, and the shoulder 38 rests just below the edge 37 so that the slider 18 is held at the bottom of the tape 8 by the pillar 36.

Figure 3C:
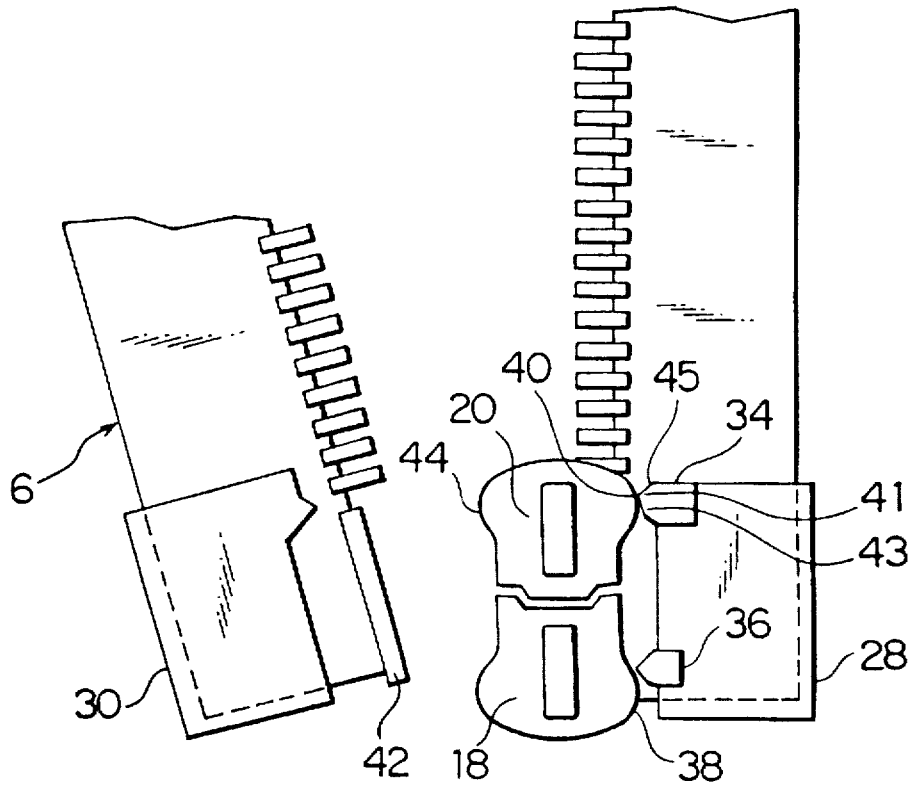

In FIG. 3(C) the upper slider 20 has been slid down to mate with the lower slider 18, the shoulder 40 of the slider 20 engaging an upper sloping surface 45 on the upper pillar 34 and moving just past a projecting edge 41 on the pillar 34. The user will feel when the shoulder 40 rides past the projecting edge 41. After the shoulder 40 rides past the projecting edge 41, the shoulder 40 maintains contact with the pillar 34 at a lower sloping surface 43. The lower sloping surface 43 has a gentler slope, relative to the path of the shoulder 40, than the upper sloping surface 45, so that less force is required to move the slider 18, 20 upwards along the stringer 4, past the projecting edge 41.

It will be appreciated that the upper and lower sliders 20, 18 may be slid simultaneously to the end of the stringer 4.

Figure 3D:
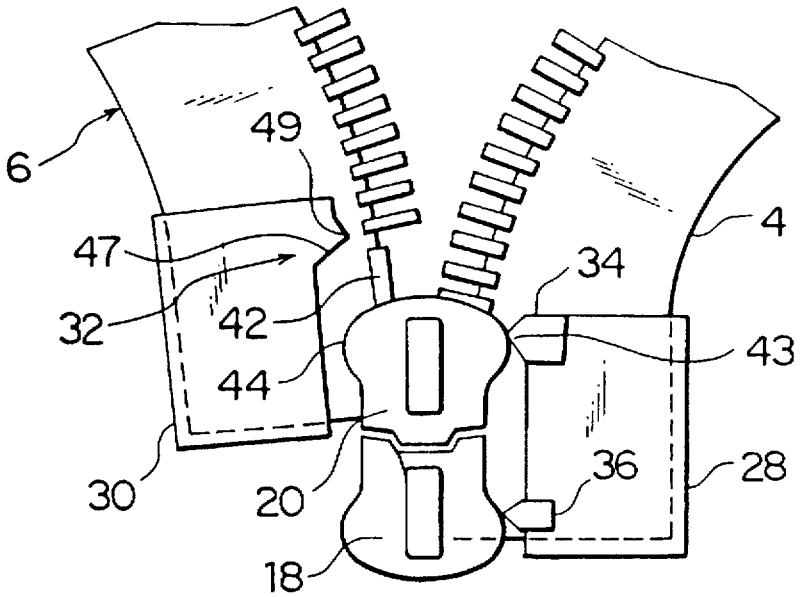

FIG. 3(D) shows the male movable parts pin 42 being inserted into the slider 20 and about to be pushed home into the slider 18. As the pin 42 is pushed fully home, a lower sloping surface 47 rides over the shoulder 44 and the user will feel when a projecting edge 49 passes the shoulder 44, indicating when the pin 42 is pushed fully home.

The zip fastener can then be closed in the usual way by pulling the upper slider 20 upwards, the slider 20 riding past the pillar 34.

When the interference means 28, 30 is formed of plastics, it is likely that the parts will wear over time, reducing the "feel" given to the user. However, at this stage the user should be sufficiently familiar with the zip fastener for the feel to be unnecessary.

Figure 4:
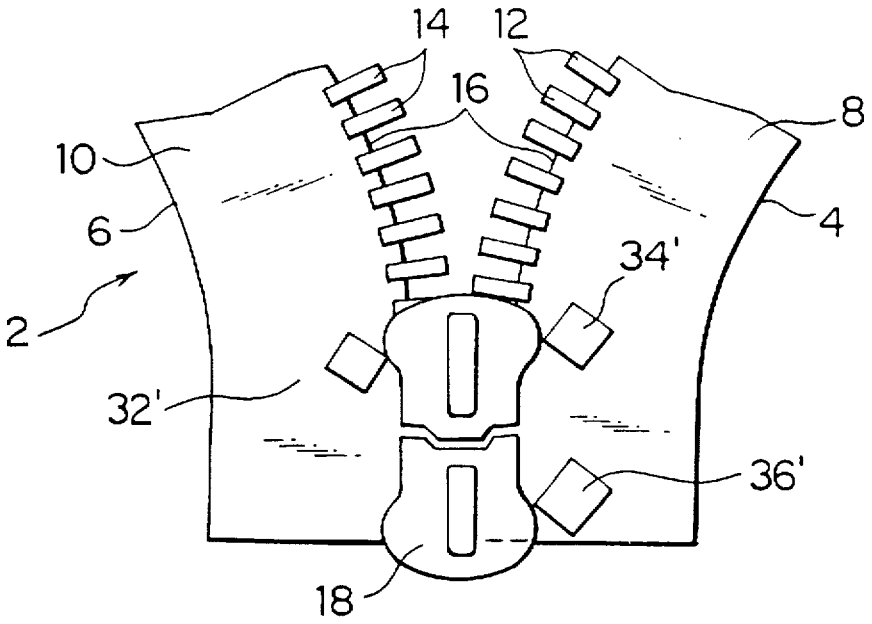
FIG. 4 is a fragmentary plan view of a modification of the embodiment of FIG. 1.

In the modification shown in FIG. 4, the interference means are formed as discrete protrusions on the tape. The protrusions 32', 34', 36' extend above and below the plane of the tape and are formed by insert moulding, the plastics material passing through the tape weave. The protrusions may be formed of metal, for example, discrete pins or rivets may be attached to the tapes 8, 10.

Also the interference means may project only from one side of the tape 8, 10.

Figure 5:
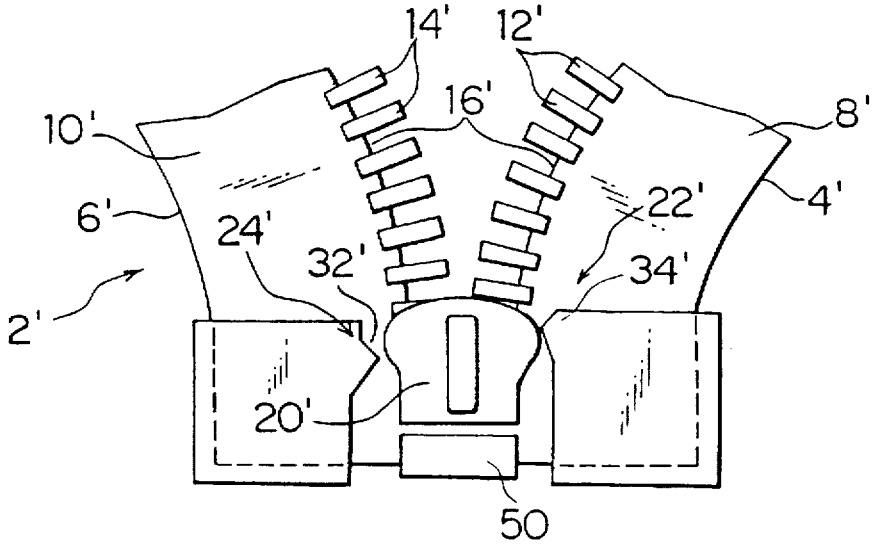
FIG 5 is a fragmentary plan view of another embodiment of the invention.

In the embodiment of FIG. 5, the zip fastener 2' has only one slider. The construction and operation of the zip fastener 2' of this embodiment is similar to the embodiment FIGS. 1 to 3. A single slider 20' is provided. The male movable open parts pin (not shown) is pushed into the slider 20' and enters an end stop 50 which is attached to the tape 8 of the other stringer 4 as is well known in the art.

As is apparent from the foregoing, with the zip fastener 2 of the invention, since the interference means 22, 24, 26 is provided at the bottom of the fastener for feeling the passing of the slider 18, 20, even when the user is wearing the gloves or the user can not see, the user can recognize the position of the interference means 22, 24, 26. Thus in the case of the separable-type zip fastener, it is possible to surely insert the male movable open parts pin 42 to position at such as the bottom stop at the bottom end.

What is claimed is:

1. A zip fastener having a slider and a pair of stringers, each stringer comprising coupling elements on a tape, wherein interference means is provided on at least one of the tapes to hinder the movement of the slider and so indicate by feel to a user a position of the slider along the tape.

2. A zip fastener as claimed in any one of claims 1, wherein each of the interference means is formed by a plastics moulding provided on the respective stringer tape.

3. A zip fastener as claimed in claim 2, wherein the moulding carries a logo.

4. A zip fastener as claimed in claim 1, wherein a first interference means is provided at the end of the tape on which the slider is permanently mounted to indicate when the upper slider is positioned for receiving the male movable open parts pin.

5. A zip fastener as claimed in claim 4, having a pair of upper and lower sliders.

6. A zip fastener as claimed in claim 4, wherein the first interference means comprises on its tape edge side upper and lower sloping surfaces, sloping of said lower sloping surface being gentler than that of said upper sloping surface.

7. A zip fastener as claimed in claim 4, wherein a second interference means is provided on the tape carrying the male movable open parts pin, to indicate when the male movable open parts pin has been inserted fully into the slider.

8. A zip fastener as claimed in claim 7, having a pair of upper and lower sliders.

9. A zip fastener as claimed in claim 1, having a pair of upper and lower sliders.

10. A zip fastener as claimed in claim 9, wherein the first interference means is positioned so that it bears on each of the upper and lower sliders as each of the upper and lower sliders is slid to the end of the stringer.

11. A zip fastener as claimed in claim 10, wherein the first interference means comprises on its tape edge side upper and lower sloping surfaces, sloping of said lower sloping surface being gentler than that of said upper sloping surface.

12. A zip fastener as claimed in claim 10, wherein a third interference means is provided to indicate when the lower slider is positioned at the end of the stringer, and the first interference means indicates when the upper slider is positioned for receiving the male movable open parts pin.

13. A zip fastener as claimed in claim 1, wherein the interference means comprises a laterally extending projection having an edge releasably engaged with a shoulder on a side with a slider.

* * * * *